US007198116B1

(12) United States Patent
Chen

(10) Patent No.: US 7,198,116 B1
(45) Date of Patent: Apr. 3, 2007

(54) WHOLLY AIR-CONTROLLED IMPACT MECHANISM FOR HIGH-SPEED ENERGY-ACCUMULATING PNEUMATIC WRENCH

(76) Inventor: Xiaojun Chen, 512 N. McClurg Ct. #605, Chicago, IL (US) 60611

( * ) Notice: Subject to any disclaimer, the term of this patent is extended or adjusted under 35 U.S.C. 154(b) by 0 days.

(21) Appl. No.: 11/163,598

(22) Filed: Oct. 25, 2005

(51) Int. Cl.
*B25B 21/02* (2006.01)

(52) U.S. Cl. ..... 173/93; 173/200; 173/128; 173/208; 173/18; 91/165

(58) Field of Classification Search ..... 173/93, 173/200, 128, 208, 18, 104, 204, 218, 169, 173/206, 207, 168, 93.5; 91/165
See application file for complete search history.

(56) References Cited

U.S. PATENT DOCUMENTS

| | | | | |
|---|---|---|---|---|
| 2,585,486 | A | 2/1952 | Mitchell | 173/93.6 |
| 2,684,738 | A | 7/1954 | Kaplan | 173/93.6 |
| 2,825,436 | A | 3/1958 | Amtsberg | 173/93.6 |
| 3,001,428 | A | 9/1961 | Sindelar | 173/93.6 |
| 3,106,274 | A | 10/1963 | Madsen | 173/93.6 |
| 3,174,597 | A | 3/1965 | Schaedler et al. | 173/93.6 |
| 3,175,660 | A | 3/1965 | Kaman | 173/93.6 |
| 3,414,065 | A | 12/1968 | Falter | 173/93.5 |
| 3,428,137 | A | 2/1969 | Schaedler et al. | 173/93.6 |
| 3,948,328 | A | 4/1976 | Hiraoka et al. | 173/181 |
| 3,952,814 | A | 4/1976 | Gelfand et al. | 173/93 |
| 4,243,108 | A | 1/1981 | Galimov et al. | 173/93 |
| 4,313,505 | A | 2/1982 | Silvern | 173/93.5 |
| 4,350,213 | A * | 9/1982 | Antipov et al. | 173/93.6 |
| 4,379,492 | A | 4/1983 | Hiraoka | 173/181 |
| 4,766,963 | A * | 8/1988 | Hartwig et al. | 173/109 |
| 5,544,710 | A * | 8/1996 | Groshans et al. | 173/176 |
| 5,718,296 | A * | 2/1998 | Chen | 173/17 |
| 5,740,892 | A | 4/1998 | Huang | 192/43.1 |
| 5,752,571 | A * | 5/1998 | Sapozhnikov | 173/206 |
| 5,806,640 | A * | 9/1998 | Sapozhnikov | 173/206 |
| 5,836,403 | A | 11/1998 | Putney et al. | 173/205 |
| 5,887,666 | A | 3/1999 | Chen et al. | 173/93.5 |
| 6,155,353 | A * | 12/2000 | Ottestad | 173/128 |
| 6,609,577 | B2 * | 8/2003 | Beccu | 173/93.6 |
| 6,782,956 | B1 * | 8/2004 | Seith et al. | 173/1 |
| 6,863,134 | B2 * | 3/2005 | Seith et al. | 173/1 |
| 2004/0173364 | A1 * | 9/2004 | Seith et al. | 173/1 |
| 2005/0247462 | A1 * | 11/2005 | Meixner et al. | 173/48 |
| 2006/0113099 | A1 * | 6/2006 | Livingston et al. | 173/177 |

* cited by examiner

*Primary Examiner*—Brian Nash
(74) *Attorney, Agent, or Firm*—Julia R. Chen

(57) ABSTRACT

A wholly air-controlled impact mechanism invented for creating a more compact and powerful pneumatic wrench comprises a flying hammer, a pressure impulse generator and a pressure container containing the hammer and the generator. The main part of the flying hammer is a flywheel with 2 cavities and a number of air passages. A pilot valve and an impact pin are fitted in the cavities. The impact pin rests in its cavity during energy-accumulation phase and stretches out rapidly from the flywheel to finish an impact during impact phase. The generator transmits pressure impulse periodically, affecting the differential pressure acting on the pilot valve. The higher the differential pressure, the greater the impact torque developed. The unique design of the air passages of present invention results in a very reliable, powerful and durable energy-accumulating pneumatic wrench. Its production cost is much lower due to simplicity of its configuration.

18 Claims, 8 Drawing Sheets

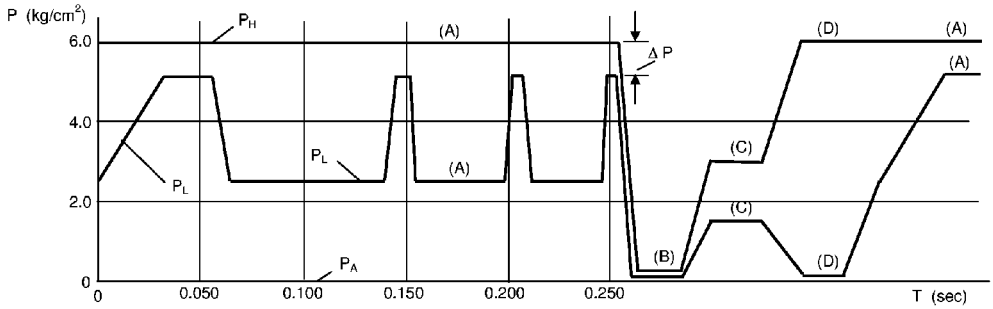
FIG.7A
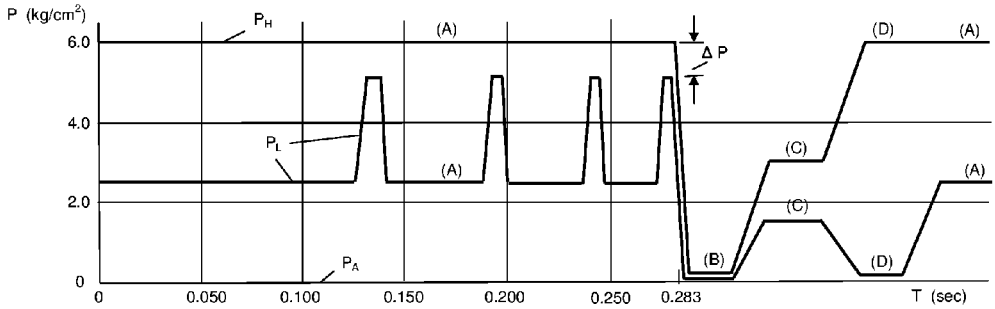
FIG.7B
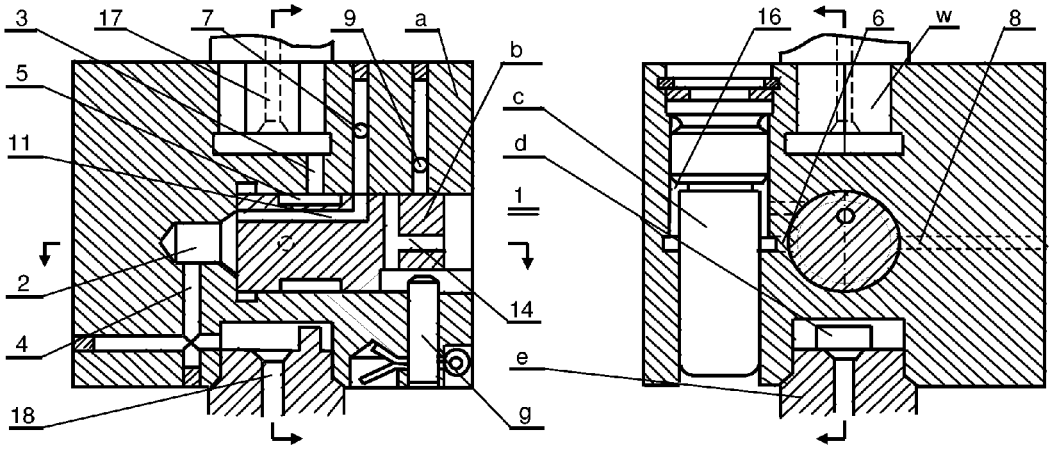
FIG.8 For front page view

WHOLLY AIR-CONTROLLED IMPACT MECHANISM FOR HIGH-SPEED ENERGY-ACCUMULATING PNEUMATIC WRENCH

BACKGROUND OF THE INVENTION

The invention is related to a wholly air-controlled impact mechanism for creating more compact, reliable, economical and powerful pneumatic devices, such as a pneumatic wrench.

The pneumatic wrench, driven by an air motor, is an efficient tool for mounting and dismounting bolts and nuts. Various mechanisms have been adopted by manufacturers. For decades, inventors and entrepreneurs have made great efforts to improve the performance of pneumatic wrenches. The energy-accumulating pneumatic wrench attracts the most attention. An air motor drives a flying hammer to a high speed. Subsequently, an impact pin stretches out from the hammer and imposes an impact torque on the anvil shaft. The higher the speed of the hammer, the larger the impact torque. Reliable and precise control of the motion of the impact pin is the key to unlock the full energy accumulated in the flying hammer.

FIG. 1 shows the action principle of a typical traditional design of impact mechanism for energy-accumulating pneumatic wrench. A brief description of its construction is as follows:

An eccentric pilot valve (b) is fitted in the cavity of a flywheel (a) and may slide along the radial direction. The pilot valve (b) is held in its retracted position by a spring (m) and a draw bar (n). An impulsive time-delay trigger is disposed in another cavity of the flywheel (a). It consists of a small spring (h), a trigger pin (l), a plunger (k) and an end cam (j) mounted on the anvil shaft.

During energy accumulation phase, the trigger pin (l) locks the pilot valve (b) at its retracted position. The flywheel (a) rotates relative to the anvil shaft. The plunger (k) and trigger pin (l) move up and down following the profile of the end cam. The cam profile pushes the trigger pin (l) into the body of pilot valve (b) with each rotation, during which time, the pilot valve (b) is unlocked and can potentially move outward along the radius.

There is an annular plenum (5) around the cylindrical surface of the pilot valve (b). The annular plenum (5) controls the direction of controlling air. When the pilot valve (b) rests at its retracted position, the controlling air from air inlet passage (3), through annular plenum (5) and retracting passage (6), comes into the lower plenum (16) of the impact pin (c), causing the impact pin (c) to rest at its retracted position. Refer to FIG. 1A.

When the flywheel (a) rotates with sufficiently high speed, the centrifugal force of the pilot valve (b) becomes large enough to overcome the pull of the spring (m). The pilot valve (b), when prompted by the impulsive trigger mechanism, begins to move outwards until limited by a stopper (g). The outward movement of the pilot valve (b) connects the air inlet passage (3) with the stretching passage (7) through the annular plenum (5). The controlling air from the inlet passage (3) travels through the annular plenum (5) and the stretching air passage (7), and enters into the upper plenum (15) of the impact pin (c), causing the impact pin (c) to stretch out from the flywheel (a). The impact pin (c) imposes an impact torque on the anvil shaft, tightening or loosening the nut. Refer to FIG. 1B.

The speed of flywheel (a) is decreased to zero upon the impact. The centrifugal force disappears, and the pilot valve (b) is pulled back to the cavity by the spring (m). The inward movement of the pilot value (b) switches the controlling air to the lower plenum (16) of the impact pin (c) through the retracting air passage (6), causing the impact pin (c) to retreat into the flywheel (a), as shown in FIG. 1A. The system is then ready for the next cycle of energy-accumulating and impacting.

The above described energy accumulating and impacting system has been applied in commercial pneumatic wrenches. However, it has a number of drawbacks. Due to the restraints of the spring (m), the pilot valve (b) cannot move rapidly enough to quickly drive the impact pin (c) into its fully stretched position, causing a series of "sliding" phenomenon, or so called "double hits", which may result in parts damage.

The impulsive trigger mechanism improves the rapidity of outward movement of pilot valve (b). But, its effect is uncertain and unreliable due to its dependency on the initial position of the end cam (j), i.e. the initial position of the anvil shaft relative to the flywheel (a).

Furthermore, various parts of the trigger mechanism are subject to wear and tear during operations. Once the trigger fails to work properly, the flywheel (a) may reach abnormally high speed, causing accumulated energy to increase beyond the design limitation which may lead to serious damages to the impact pair.

Another disadvantage of traditional energy-accumulating pneumatic wrench is its rather small retracting force for impact pin (c). The air pressure applies to the whole surface of the piston to push the impact pin (c) out, but only to the annular surface of the piston to retract the impact pin (c). During operation, the impact pin (c) is always stuck after a "soft impact" due to friction.

These problems can be solved effectively with the wholly air-controlled impact mechanism presented herein.

SUMMARY OF THE INVENTION

This invention, a wholly air-controlled impact mechanism, comprises a flying hammer, a pressure impulse generator and a pressure container containing the hammer and the generator. The flying hammer is composed of a flywheel, a pilot valve and an impact pin. The essence of the present design is a series of air passages and chambers in the flywheel and in the pilot valve, which sequentially control the movements of the pilot valve and the impact pin, to complete the required cycles of actions, i.e., repeated impacts after energy accumulation. The novelty of this invention is that all movements of pilot valve and impact pin are wholly air-controlled. This design eliminates all parts that introduce wear and tear, as well as unreliability and inaccuracy.

At the beginning of the cycle, the pressure container is pressurized with air to facilitate retraction of the impact pin. The pressure is regulated according to the requirements of actions. A differential pressure that varies with time is applied on the end-surfaces of the pilot valve causing the pilot valve to move rapidly and decisively without restrains. The pressure impulse generator transmits pressure impulse periodically to trigger and facilitate the movement of the pilot valve. These modifications allow the mechanism to avoid all vulnerable spots of the traditional design.

The birth of wholly air-controlled impact mechanism opened up a new prospect for production of high-quality pneumatic wrenches. However, pneumatic wrench is not the only application. This system is also suitable for a wide range of applications where appropriately controlled movement or impact is required.

BRIEF DESCRIPTION OF THE DRAWINGS

FIG. 7A is the pressure curves in high- and low-pressure chambers during 4 action phases (assuming impulse generated at the beginning of each rotation);

FIG. 7B is the pressure curves in high- and low-pressure chambers during 4 action phases (assuming impulse generated at the end of each rotation);

FIG. 8 is a view for use on the front page of this patent application.

Alphabet in the drawings refers to physical substances, such as details, parts or components, while numerical refers to void spaces, such as air passages, chambers, plenums or bores. The same part of the invention is designated by the same reference character throughout the application.

DISCLOSURE OF INVENTION

Figure 1A:
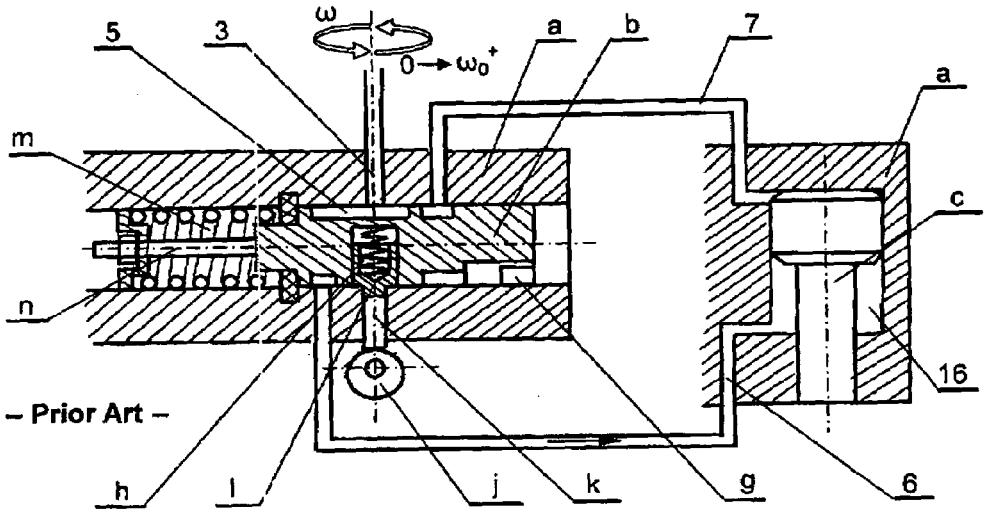
FIG. 1A is a diagrammatic layout of traditional impact mechanism during accumulation phase.
Figure 1B:
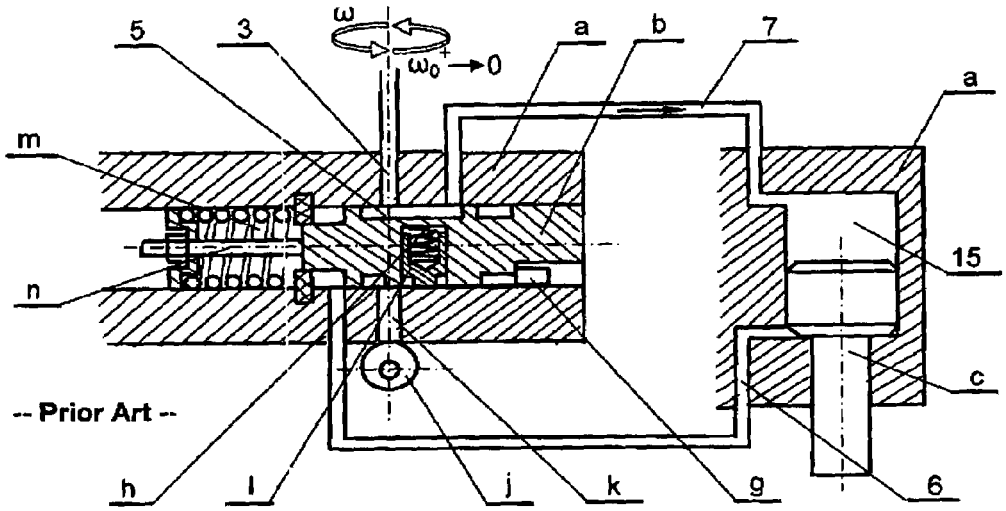
FIG. 1B is a diagrammatic layout of traditional impact mechanism during impact phase.
Figure 2:
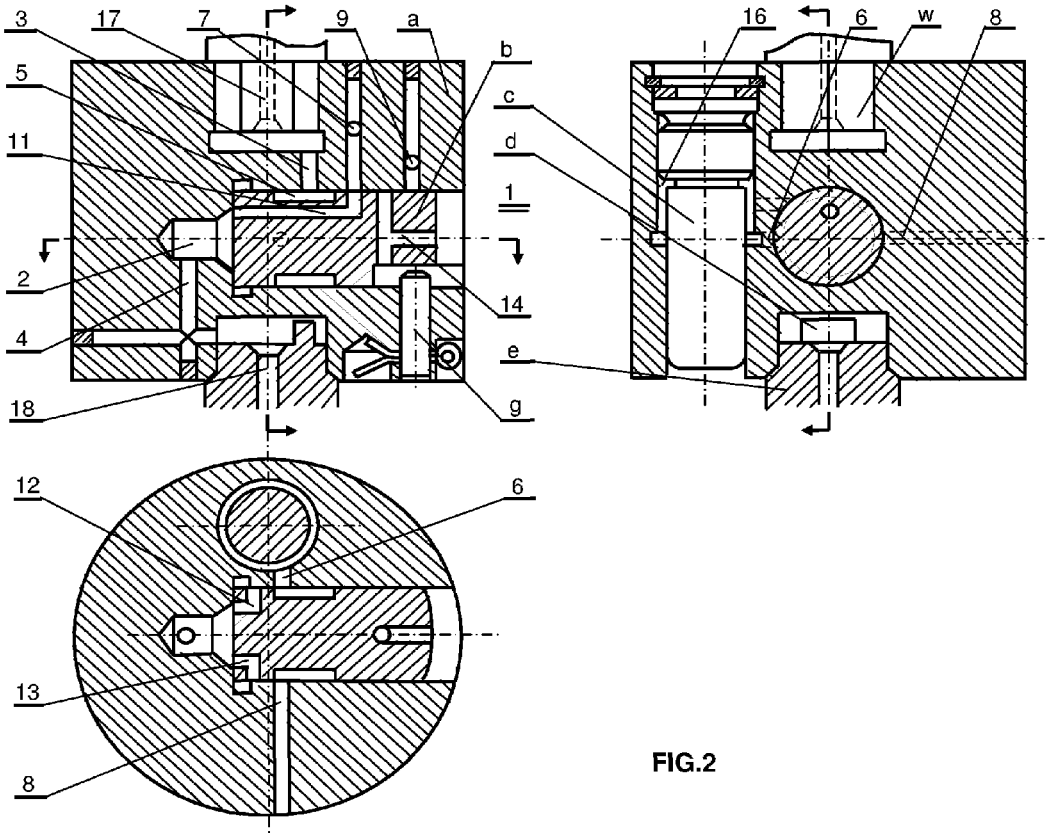
FIG. 2 is a projective drawing of the wholly air-controlled impact mechanism during accumulation phase.
Figure 3:
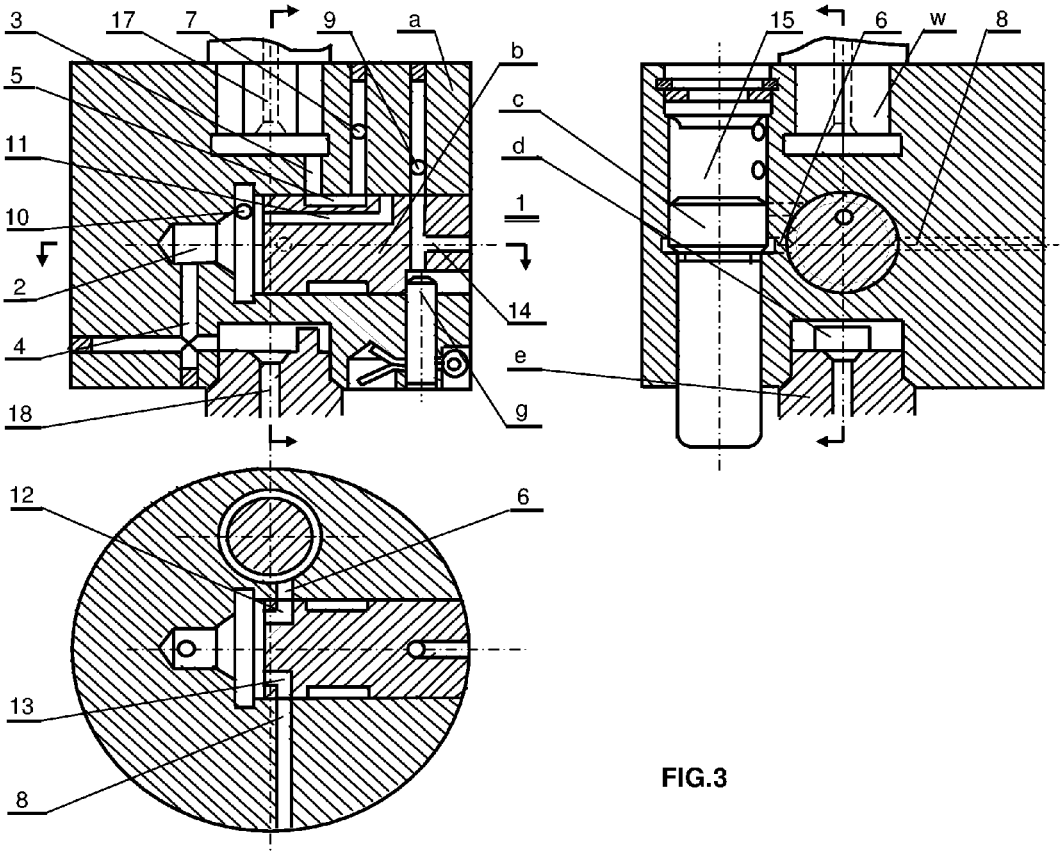
FIG. 3 is a projective drawing of the wholly air-controlled impact mechanism during impact phase.
Figure 6:
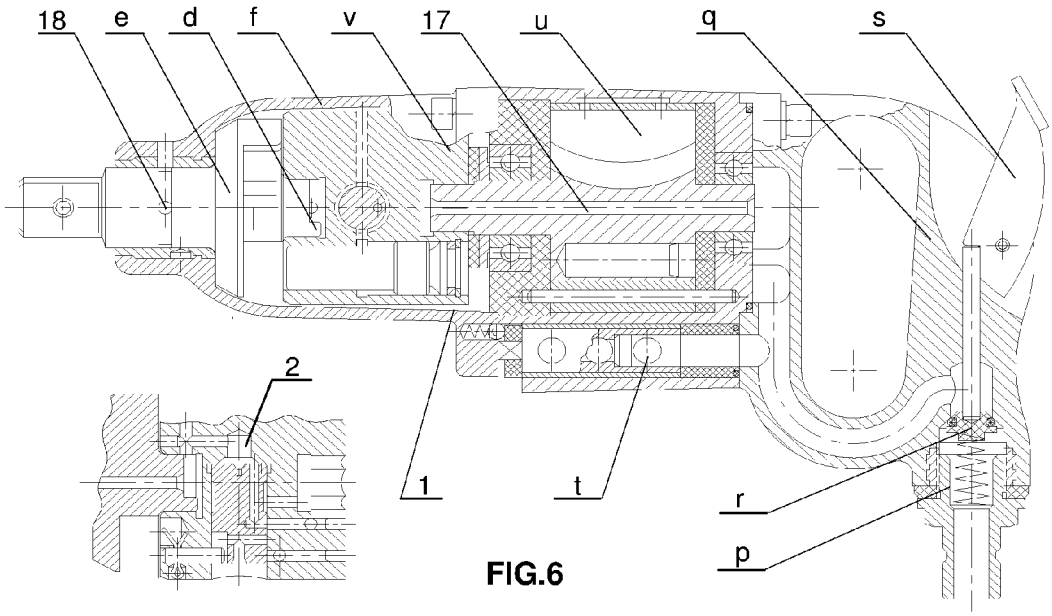
FIG. 6 is a sectional drawing of a high-speed energy-accumulating pneumatic wrench embodied with the wholly air-controlled impact mechanism of present invention.

FIGS. 2 and 3 show the structure of the wholly air-controlled impact mechanism of present invention. FIG. 6 is a sectional drawing of a high-speed energy-accumulating pneumatic wrench embodied with said wholly air-controlled impact mechanism. The flying hammer of present invention consists of three parts: a flywheel (a), a pilot valve (b) and an impact pin (c).

The first improvement of this invention is the design of a high-pressure chamber (1) outside the flying hammer and a low-pressure chamber (2) inside the flying hammer. The pressure in both chambers (1, 2) is controlled by changing the interconnection of air passages in the flywheel (a) and the pilot valve (b). The variable differential pressure between high- and low-pressure chambers (1, 2), rather than the pulling force of the spring in a traditional design, causes the movement of the pilot valve. Hence, the unnecessary restraint of the spring of traditional design is completely eliminated. Refer to FIGS. 2, 3 and FIG. 6.

The second improvement of this invention is the installation of the pressure impulse generator (d), which replaces the cam-trigger in the traditional design. The pressure impulse generator (d) may be a segmental block positioned at the end of anvil shaft (e), which periodically interferes in the opening of air outlet passage (4) and introduces pressure impulses to the low-pressure chamber (2). The pressure impulse generator (d) in its nature is a throttle valve with a throttle capacity that is changed periodically with the rotation of the flying hammer. The pressure impulse generator (d) not only serves as a trigger, but also helps to determine the critical differential pressure between high- and low-pressure chambers (1, 2), which triggers the pilot valve to be thrown out. The adoption of pressure impulse generator (d) eliminates those parts that are subject to wear and tear in the traditional design. With this improved design, under no scenario would the pilot valve (b) get stuck during operation.

The third improvement of the present invention is the design of a number of air passages inside the flywheel (a) and the pilot valve (b) that sequentially control the movement of the pilot valve (b) and the impact pin (c).

The seven air passages inside the flywheel (a) are as follows: Air inlet passage (3); Air outlet passage (4); Retracting passage (6); Stretching passage (7); Charging/discharging passage (8); Upper feedback passage (9); Lower feedback passage (10).

The annular plenum and four air passages on or inside the pilot valve (b) are as follows: Annular plenum (5); Upper residual air release passage (11); Lower residual air release passage (12); Discharging passage (13); Upper feedback continuation passage (14).

To complete the air-flow path, there is an air-inlet bore (17) along the axle of motor driving shaft (w) and an air-outlet bore (18) along the axle of anvil shaft (e) in the present invention.

The movement of the impact pin (c) is subject to the air pressure in the upper plenum (15) and the lower plenums (16), as well as the pressure in the high-pressure chamber (1). The movement of the pilot valve (b) is subject to the centrifugal force, as well as the differential pressure between high- and low-pressure chambers (1, 2). The outward movement of the pilot valve (b) is limited by a stopper (g) and its inward movement by the inside wall of the flywheel (a).

The action principle of the wholly air-controlled impact mechanism for high-speed energy-accumulating pneumatic wrench may be divided into four phases: (A) Accumulation phase; (B) Pre-impact phase; (C) Impact phase; (D) Pre-accumulation phase. Refer to FIGS. 4A, 4B, 4C, 4D.

Before compressed air enters into the pneumatic wrench, both of pilot valve (b) and impact pin (c) are under floating condition. Their positions depend upon the force of gravity.

Compressed air is split into two branches after entering into the pneumatic wrench. One branch is directed to drive the air-motor, while the other one is directed for controlling the impact mechanism. The controlling air, passing through the air-inlet bore (17) along the axle of the motor driving shaft and cutting across the boundary of the pressure container (f), enters the air inlet passage (3) of the flywheel (a), and then the annular plenum (5) of the pilot valve (b).

From the annular plenum (5), a portion of the controlling air pressurizes the high-pressure chamber (1) via the charging/discharging passage (8). The high pressure thus formed causes the pilot valve (b) to reliably rest on its retracted position. The remainder of the controlling air comes into the lower plenum (16) of the impact pin (c) through the retracting passage (6). The pressure in the lower plenum (16) together with the pressure in the high-pressure chamber (1) causes the impact pin (c) to retract.

When the impact pin (c) is fully retracted, the lower feedback passage (10) is opened up. Compressed air, passing through the lower feedback passage (10), the low-pressure chamber (2), the air outlet passage (4) and the pressure impulse generator (d), is released into the atmosphere via the air-outlet bore (18) of the anvil shaft (e). This flow path guarantees a positive differential pressure between the high-pressure chamber (1) and the low-pressure chamber (2).

In order to reduce the resistance against the upward movement of the impact pin (c), the residual air in the upper plenum (15) of the impact pin (c) is also released into the low-pressure chamber (2) via the stretching passage (7) and the upper residual air release passage (11).

Figure 4A:
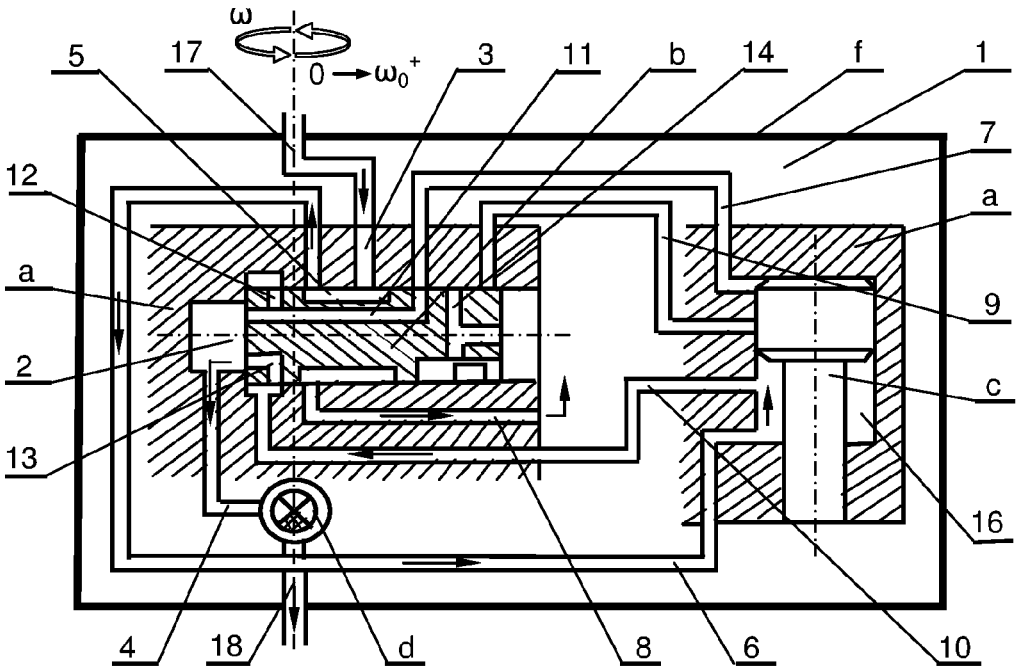
FIG. 4A is a diagrammatic layout of the wholly air-controlled impact mechanism during accumulation phase.

As the pilot valve (b) and impact pin (c) rest on their respective retracted positions, the air-motor is able to start and increase the speed of flying hammer. The pressure impulse generator (d) throttles the air flow briefly at each rotation of the flying hammer, causing the pressure in the low-pressure chamber (2) to increase impulsively at each rotation. This is the accumulation phase of the cycle. Refer to FIG. 4A.

With the increase of the speed of the flying hammer, the centrifugal force of the pilot valve (b) is increased. When the speed reaches the critical speed, the pilot valve (b) is thrown out rapidly with the additional help of the pressure impulse generated in the low-pressure chamber. The outward movement of the pilot valve (b) switches the interconnection of air passages.

First, the rearrangement in air passage interconnection caused by the outward movement of the pilot valve (b) changes the function of the charging/discharging passage (8). Instead of serving as the air passage for pressurization of the high-pressure chamber (1), the charging/discharging passage (8) now serves as the air passage for depressurization of the high-pressure chamber (1) by allowing air to flow through into the low-pressure chamber (2) via the discharging passage (13). The pressure at the high-pressure chamber (1) is reduced to close to that of the low-pressure chamber (2). On one hand, this ensures a rapid, decisive and full range outward movement of the pilot valve (b). On the other hand, this facilitates a more reliable stretch of the impact pin (c) by reducing the pressure on the end surface of the impact pin (c).

Figure 4B:
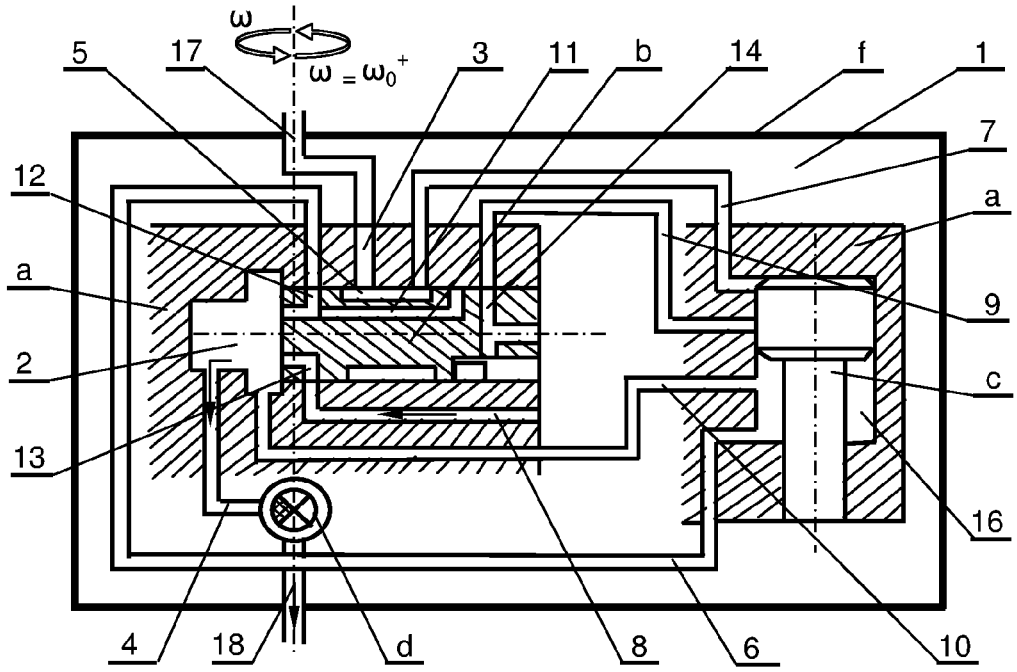
FIG. 4B is a diagrammatic layout of the wholly air-controlled impact mechanism during pre-impact phase.

Second, the annular plenum (5) of the pilot valve (b) connects the air-inlet passage (3) with the stretching passage (7), and the retracting passage (6) with the lower residual air release passage (12), creating conditions for the stretch of the impact pin (c). This is the pre-impact phase of the cycle. Refer to FIG. 4B.

The outward movement of the pilot valve (b) and change of interconnection of air passages are preludes to performing the main function of the pneumatic wrench, i.e., the controlling air from air inlet passage (3), passes through the annular plenum (5), the stretching passage (7), enters into the upper plenum (15) of the impact pin (c) and pushes out the impact pin (c) to perform an impact.

When the impact pin (c) is fully stretched out, the upper feedback passage (9) is opened up. The controlling air, passing through the upper feedback passage (9), the upper feedback continuation passage (14), the high-pressure chamber (1), the charging/discharging passage (8), the discharging passage (13), the low-pressure chamber (2), the air outlet passage (4), the pressure impulse generator (d) and the air-outlet bore (18) of the anvil shaft (e), discharges into the atmosphere. This re-built air-flow path restores a positive differential pressure between high- and low-pressure chambers (1, 2). When the speed of the flywheel (a) is reduced to zero upon the impact, the differential pressure enables the pilot valve (b) to reliably retreat into the flywheel (a).

Figure 4C:
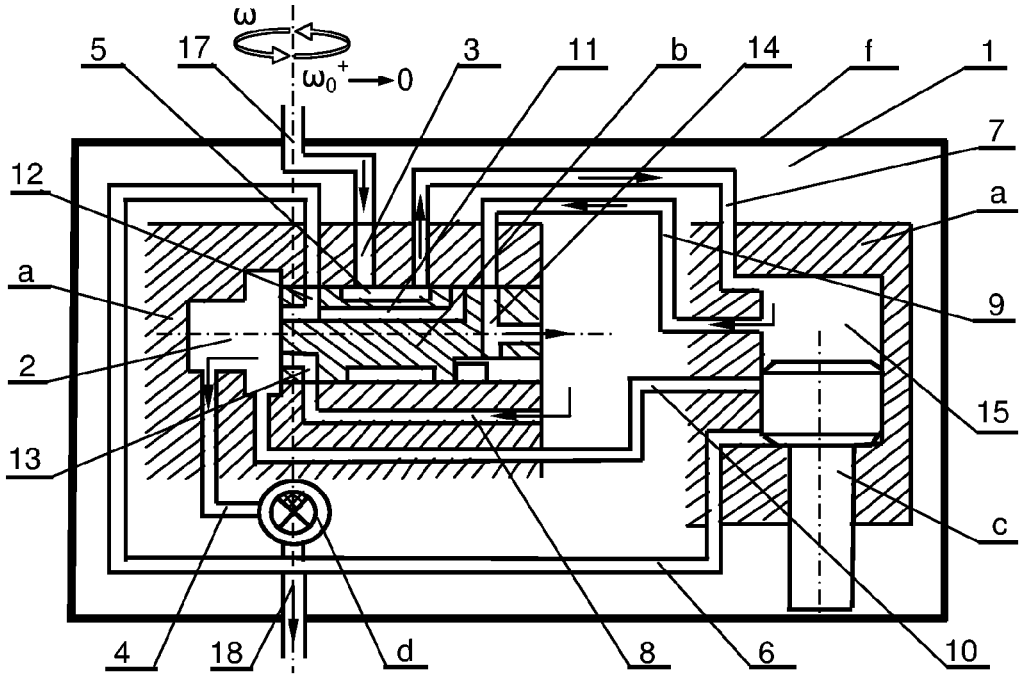
FIG. 4C is a diagrammatic layout of the wholly air-controlled impact mechanism during impact phase.

In order to reduce the resistance against the downward movement of the impact pin (c), the residual air in the lower plenum (16) is released into the low-pressure chamber (2) via the retracting passage (6) and the lower residual air release passage (12). This is the impact phase of the cycle. Refer to FIG. 4C.

The speed of the flywheel (a) reduces to zero upon the impact. The centrifugal force of the pilot valve (b) subsequently disappears. The differential pressure between high- and low-pressure chambers (1, 2) pushes the pilot valve (b) back to its retracted position. The retraction of the pilot valve (b) changes the interconnection of the air passages.

First, the annular plenum (5) connects the air inlet passage (3) with the charging/discharging passage (8) for pressurization of the high-pressure chamber (1). The high pressure thus formed not only causes the pilot valve (b) to quickly and reliably restore its retracted position, but also creates the proper pressure condition for the retraction of the impact pin (c).

Figure 4D:
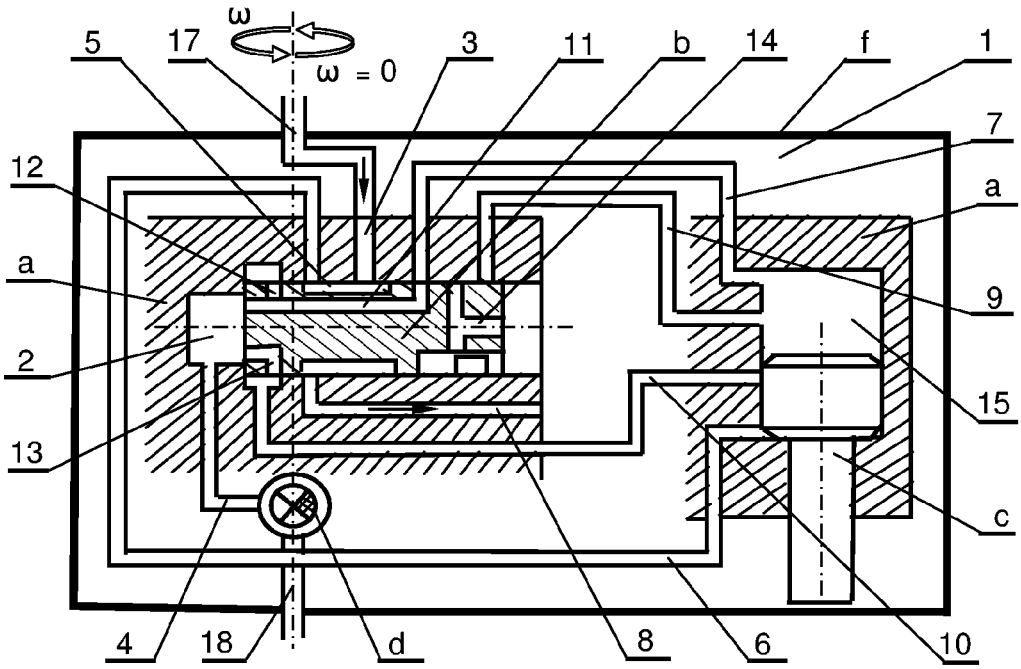
FIG. 4D is a diagrammatic layout of the wholly air-controlled impact mechanism during pre-accumulation phase.

Second, the annular plenum (5) connects the air-inlet passage (3) with the retracting passage (6). Meanwhile, the stretching passage (7) is connected with the upper residual air release passage (11). The prelude to retraction of impact pin is thus completed. This is the pre-accumulation phase of the cycle. Refer to FIG. 4D.

With the pilot valve (b) and impact pin (c) in their fully retracted positions as shown in FIG. 4A, the flying hammer driven by air motor begins to gain speed again. The system enters into the next cycle.

The use of the wholly air-controlled impact mechanism described in this application is not limited to pneumatic wrench. It can have a wide range of application, including, but not limited to, tools, toys, apparatuses, machines, where similar movement or action is desired. By virtue of the flexibility of air passages, the dimension and configuration of the components of the mechanism can be modified without departing from the scope of the present invention, e.g. a wholly air-controlled mechanism with two synchronized impact pins. It is intended that all matters contained in the above description or shown in the accompanying drawings be interpreted as illustrative and not in a limiting sense.

Figure 5:
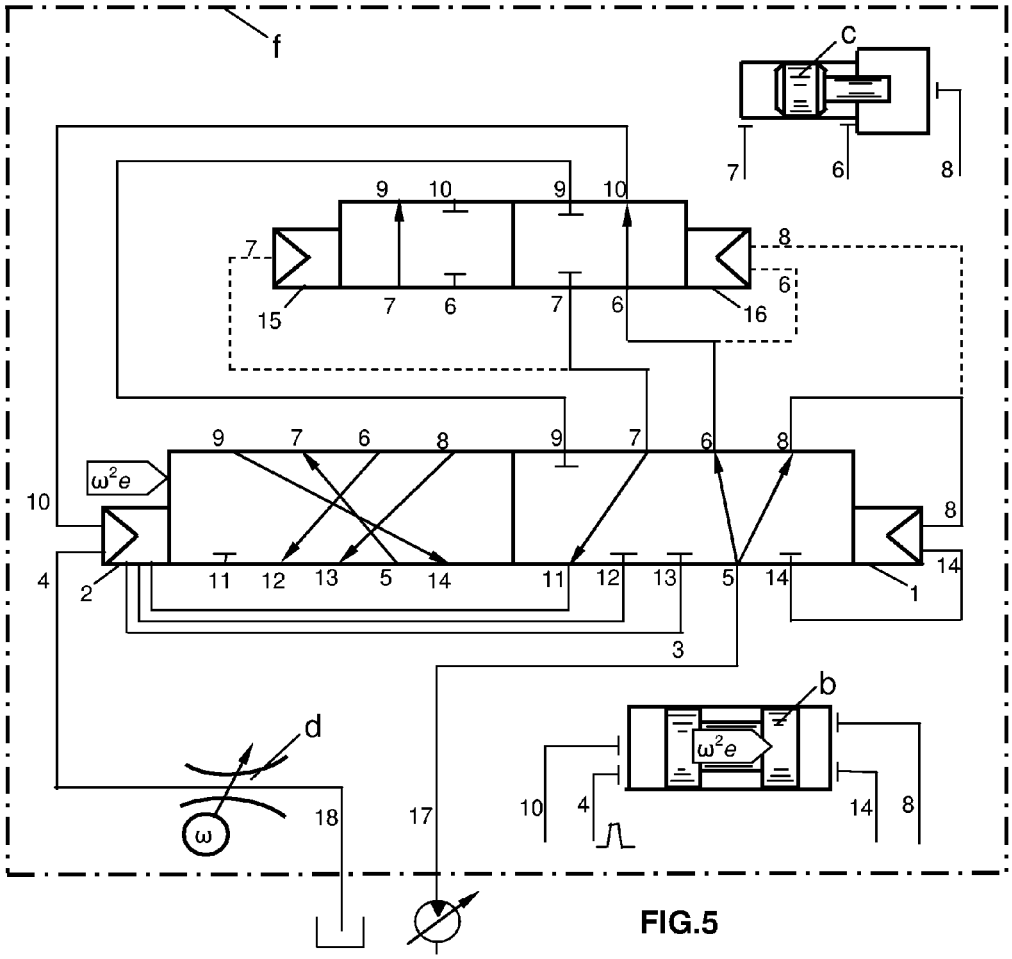
FIG. 5 is a pneumatic circuit drawing of the wholly air-controlled impact mechanism of present invention.

FIG. 5 is a pneumatic circuit drawing of the wholly air-controlled impact mechanism presented by the fluid power symbols that conform to ANSI as mush as possible. It is thus clear that the impact mechanism of present invention comprises three control elements:

1. A two-position, nine-port, seven-way, centrifugal force and differential pressure actuated directional control valve;

2. A two-position, four-port, two-way, pressure actuated directional control valve;

3. A revolution-regulated throttle valve.

The actuating signals for piston of impact pin are shown separately on the upper-right corner of the drawing, while the actuating signals for pilot valve are shown on the lower-right corner of the drawing. The centrifugal force and pressure impulse serving as actuating signals are the particularity of the present invention.

FIG. 6 is a sectional drawing of a high-speed energy-accumulating pneumatic wrench embodied with the wholly air-controlled impact mechanism of the present invention. A compressed air hose nozzle (p) is mounted at the handle (q) of the pneumatic wrench. A compressed air inlet valve (r) inside the nozzle (p) is controlled by an operation lever (s). Upon pressing the operation lever (s), compressed air enters the wrench. Most air is directed to drive the air motor (u). The rotation direction of the air motor (u) can be changed through the use of a reverse valve (t). The above mentioned components may vary from design to design, but they are more or less conventional practice in pneumatic tool industry.

The following aspects of the novelty of the embodiment of present invention are worth emphasizing:

The air-motor (u) is designed with an extended driving shaft, which penetrates the boundary of pressure container (f) with appropriate seals in order to keep air-tightness of the pressure container (f). The motor shaft is directly coupled to the flywheel (a) transmitting driving force to the flying hammer. There is an air-inlet bore (17) along the motor driving shaft aligned with the air inlet passage (3) for supplying controlling air to the impact mechanism (v).

The wholly air-controlled impact mechanism (v) is fitted in the pressure container (f) which can stand the maximum pressure of the controlling air and is separated with the housing of air motor by partitions.

The anvil shaft (e) penetrates the pressure container (f) on the other end for impact torque transmission. The anvil head inside the pressure container (f) has two anvil faces for receiving impact from both directions. A segmental block is mounted on the end of the anvil shaft (e). The segmental block performs the function of the pressure impulse generator (d), which partially blocks the opening of air outlet passage (4) at each rotation of the flying hammer for a short period of time. There is an air-outlet bore (18) along the anvil shaft (e) for releasing exhausted controlling air from the impact mechanism (v) to the atmosphere.

FIGS. 7A, 7B show the pressures ($P_H$, $P_L$) in the high- and low-pressure chambers (1, 2) of said pneumatic wrench throughout the four phases of the cycle. The impulse generated by the pressure impulse generator (d) can take place at any moment of the rotation of the flying hammer depending upon the initial position of the anvil shaft (e). The pressure curves in FIG. 7A are based on the impulse taking place at the beginning of each rotation, and those in FIG. 7B are based on the impulse taking place at the end of each rotation.

The pressure curves for energy accumulation phase (A) which lasts about 0.25 sec were obtained based on both experimental data and calculations. The calculation does not take into consideration the mass inertia of the pilot valve or the impact pin; neither does it take into consideration the volume inertia of high- or low-pressure chambers.

The pneumatic wrench embodied with the wholly air-controlled mechanism of the present invention reaches a critical speed of 1500 rpm after 4 revolutions. It may be concluded from the pressure curves that there is good potential of increasing the critical speed to higher than 1500 rpm by reducing the amplitude of pressure impulse, i.e. by increasing the critical differential pressure $\Delta P$ between high- and low-pressure chambers. It would make the pneumatic wrench with same weight and dimensions more powerful in comparison with others. The high performance and high capacity of above described pneumatic wrench, combined with its compactness and lightness, makes this tool especially suitable for fields such as oil exploration and production, automobile manufacturing and repair, railway maintenance, military and astronautic applications.

The curves for phases (B), (C), (D), which represent a very short time period of no more than 0.01 second, are illustrative. They are presented herein to display the ideal control result which can potentially be achieved by the present invention. They also illustrate how the preceding phase achieves the pressure conditions for the succeeding one. Please note that the time scale for these three phases is not drawn to proportion. In view of the rapidity of the movements during phases (B), (C), (D), it may be concluded that the inertia of masses and volumes, as well as the strength of materials, might be the limiting factors for reaching maximum speed.

More theoretical and experimental investigations will be carried out to optimize the parameters of the present invention. A number of research projects have been planned to improve its performance. Nevertheless, the simplicity of the configuration allows the wholly air-controlled impact mechanism to be almost trouble free during operation. It is proved that the mechanism demonstrated herein is capable of operating steadily under a wide range of compressed air pressure. It is also less noisy during operation.

What is claimed is:

1. A wholly air-controlled impact mechanism consisting of a pressure container containing a flying hammer and a pressure impulse generator, with a driving shaft and an anvil shaft penetrating said pressure container; said pressure container forming a high-pressure chamber with its volume unoccupied by said flying hammer and said pressure impulse generator and capable of withstanding the pressure variations of the controlling air and serving as a part of the controlling air flow path; said flying hammer comprising a flywheel characterized by two cavities which contain an eccentric pilot valve and an impact pin, and also characterized by seven air-passages to control the movement of said pilot valve and said impact pin; said pilot valve characterized by an annular plenum and four air-passages for switching controlling air directions; said impact pin imposing impact torque on said anvil shaft during stretching out and switching air-passages by the movement of its piston; said pressure impulse generator including a part integrated with and situated on the end surface of said anvil shaft and periodically interfering in the controlling air flow path and thus generating pressure impulses to affect the movement of said pilot valve with rotation of said flying hammer; said driving shaft, penetrating one end of said pressure container to drive said flying hammer into rotation, with an air-inlet bore along its axle for supplying fresh controlling air to said wholly air-controlled impact mechanism; said anvil shaft, penetrating another end of said pressure container to transmit impact torque, with an air-outlet bore along its axle for discharging exhausted controlling air into atmosphere.

2. A wholly air-controlled impact mechanism as set forth in claim 1 wherein said pressure container is a generally cylindrical vessel, sealed appropriately so that the pressure can be built up during pressurization, adopting a driving shaft with an air-inlet bore penetrating its one end and an anvil shaft with an air-outlet bore penetrating its other end.

3. A wholly air-controlled impact mechanism as set forth in claim 1 wherein said flywheel is characterized by its two cavities:

i) first cavity, designed for accommodating said pilot valve, having a multi-cylindrical form, not only allowing said pilot valve to reciprocate between its retracted position and stretched position in the cavity along the radial direction of said flywheel, but also forming a low-pressure chamber inside said flywheel; the low pressure chamber, serving as a part of the controlling air flow path, is a space confined by the walls of the first cavity and the end surface of said pilot valve inserted and therefore its volume is changed with the movement of said pilot valve; the shape of the end walls of the first cavity is designed to stop the said pilot valve at its retracted position and keep a minimum volume of said low-pressure chamber; and wherein a stopper is installed in the first cavity to restrict the outward movement and rotation of said pilot valve; consequently, one end-surface of said pilot valve is exposed to the low-pressure chamber, while the other one to the high-pressure chamber;

ii) second cavity, designed for accommodating said impact pin, having a cylindrical form and separated by the piston of said impact pin into an upper plenum and a lower plenum; one end of the second cavity has an opening allowing said impact pin to stretch out, while the other end is plugged after said impact pin is installed.

4. A wholly air-controlled impact mechanism as set forth in claim 1 wherein said flywheel is further characterized by its seven air passages:

i) an air inlet passage leading controlling air from the air-inlet bore of said driving shaft to the annular plenum of said pilot valve;

ii) an air outlet passage, leading controlling air from the low-pressure chamber to said pressure impulse generator, having an inlet within the walls of the minimum volume of said low-pressure chamber so that its opening is never blocked by the movement of said pilot valve and an outlet against said pressure impulse generator to receive the pressure impulses;

iii) a charging/discharging passage connecting the high-pressure chamber with the annular plenum of said pilot valve when said pilot valve is retracted (to direct air into the high-pressure chamber for its pressurization during pre-accumulation phase (D) and accumulation phase (A)), or connecting the high-pressure chamber with a discharging passage in said pilot valve when said pilot valve is thrown out (to discharge air from the high-pressure chamber for its depressurization during pre-impact phase (B), or to form a positive differential pressure between high- and low-pressure chambers by building up an air-flow path during impact phase (C));

iv) a stretching passage, having an outlet at the top of the upper plenum of the second cavity, connecting the annular plenum of said pilot valve with the upper plenum of the second cavity when said pilot valve is thrown out (to stretch said impact pin during pre-impact phase (B) and impact phase (C)), or connecting the upper plenum of the second cavity with an upper residual air release passage in said pilot valve when said pilot valve is retracted (to release the residual air from the upper plenum during pre-accumulation phase (D) and accumulation phase (A));

v) a retracting passage, having an outlet at the bottom of the lower plenum of the second cavity, connecting the annular plenum of said pilot valve with the lower plenum of the second cavity when said pilot valve is retracted (to retract said impact pin during pre-accumulation phase (D) and accumulation phase (A)), or connecting the lower plenum of the second cavity with a lower residual air release passage in said pilot valve when said pilot valve is thrown out (to release the residual air from the lower plenum during pre-impact phase (B) and impact phase (C));

vi) an upper feedback passage connecting the upper plenum of the second cavity with the high-pressure chamber via an upper feedback continuation passage in said pilot valve when both said pilot valve and said impact pin are fully stretched (to form a positive differential pressure between the high- and low-pressure chambers during impact phase (C)); the upper feedback passage is closed by the piston of said impact pin during accumulation phase (A) and pre-impact phase (B) and closed by said pilot valve during pre-accumulation phase (D), having an inlet at the point of the upper plenum where the inlet is fully opened as the piston of said impact pin reaches its lower limitation;

vii) a lower feedback passage connecting the lower plenum of the second cavity with the low-pressure chamber when both said pilot valve and said impact pin are fully retracted (to keep a positive differential pressure between the high-pressure and low-pressure chambers during accumulation phase (A)); the lower feedback passage is closed by the piston of said impact pin during impact phase (C) and pre-accumulation phase (D) and becomes idle during pre-impact phase (B), having an inlet at the point of the lower plenum where the inlet is fully opened as the piston of said impact pin reaches its upper limitation; and wherein all air passages in said flywheel are formed by one bore or several (generally by two) connected bores drilled from the outer surface of said flywheel; the ends of the bores which are unnecessary to connect with said high-pressure chamber are plugged at the outer surface of said flywheel.

5. A wholly air-controlled impact mechanism as set forth in claim 1 wherein said pilot valve, capable of reciprocating between two positions in the first cavity of said flywheel, is characterized by an annular plenum and its four air passages:

i) a annular plenum, as an annular slot on the cylindrical surface of said pilot valve, connecting the air inlet passage with the retracting passage and charging/discharging passage when said pilot valve is retracted (to retract said impact pin and to pressurize the high-pressure chamber during pre-accumulation phase (D) and accumulation phase (A)), or with the stretching passage when said pilot valve is thrown out (to stretch said impact pin during pre-impact phase (B) and impact phase (C));

ii) an upper residual air release passage connecting the low-pressure chamber with the stretching passage when said pilot valve is retracted (to release the residual air in the upper plenum of the second cavity during pre-accumulation phase (D) and accumulation phase (A));

iii) a lower residual air release passage connecting the low pressure chamber with the retracting passage when said pilot valve is thrown out (to release the residual air in the lower plenum of the second cavity during pre-impact phase (B) and impact phase (C));

iv) an upper feedback continuation passage connecting the high-pressure chamber with the upper feedback passage when said pilot valve is thrown out (to form a positive differential pressure between high- and low-pressure chambers by building up an air-flow path during impact phase (C));

v) a discharging passage connecting the low-pressure chamber with the charging/discharging passage when said pilot valve is thrown out (to form a near-zero differential pressure between high- and low-pressure chambers during pre-impact phase (B), or to form a positive differential pressure between high-pressure and low-pressure chambers by building up an air-flow path during impact phase (C)); and wherein all air passages in said pilot valve are formed by no more than two connected bores drilled inside said pilot valve.

6. A wholly air-controlled impact mechanism as set forth in claim 1 wherein said impact pin, capable of stretching out from or retracting back into said flywheel, is integrated with a piston which separates the second cavity of said flywheel into an upper plenum and a lower plenum and, by means of its thickness, closes the lower feedback passage and opens the upper feedback passage when said impact pin reaches its fully stretched position, or closes the upper feedback passage and opens the lower feedback passage when said impact pin reaches its fully retracted position.

7. A wholly air-controlled impact mechanism as set forth in claim 1 wherein said pressure impulse generator may be one or several segmental blocks integrated with and distributed on the periphery of the end-surface of said anvil shaft against the outlet of the air outlet passage, and transmits pressure impulse periodically to the low-pressure chamber by changing flow resistance impulsively with rotation of said flying hammer and thus triggers additional signal to said pilot valve.

8. A wholly air-controlled impact mechanism as set forth in claim 1 wherein said driving shaft is directly engaged with said flywheel and aligned with its air inlet passage.

9. A wholly air-controlled impact mechanism as set forth in claim 1 wherein said anvil shaft, with an anvil head inside said pressure container, is capable of receiving impact from both directions.

10. A high-speed energy-accumulating pneumatic wrench embodied with a wholly air-controlled impact mechanism comprises: an air motor with a driving shaft for driving the flying hammer of said wholly air-controlled impact mechanism into rotation, having an air-inlet bore along said driving shaft for supplying fresh controlling air to said wholly air-controlled impact mechanism; an anvil shaft for transmitting impact torque, having an air-outlet bore along said anvil shaft for discharging exhausted controlling air to the atmosphere; a pressure container containing said flying hammer and a pressure impulse generator, and allowing said driving shaft and said anvil shaft to penetrate its boundaries without losing its air-tightness; said pressure container forming a high-pressure chamber with its volume unoccupied by said flying hammer and said pressure impulse generator and capable of withstanding the pressure variations of the controlling air and serving as a part of the controlling air flow path; said flying hammer comprising a flywheel characterized by two cavities which contain an eccentric pilot valve and an impact pin, and also characterized by seven air-passages to control the movement of said pilot valve and said impact pin; said pilot valve characterized by an annular plenum and four air-passages for switching controlling air directions; said impact pin imposing impact torque on said anvil shaft during stretching out and switching air-passages by the movement of its piston; said pressure impulse generator including a part integrated with and situated on the end surface of said anvil shaft and periodically interfering in the controlling air flow path and thus generating pressure impulses to affect the movement of said pilot valve with each rotation of said flying hammer; said driving shaft penetrating one end of said pressure container while said anvil shaft penetrating another end of said pressure container.

11. A high-speed energy-accumulating pneumatic wrench as set forth in claim 10 wherein said pressure container is a generally cylindrical vessel, sealed appropriately so that the pressure can be built up during its pressurization, adopting said air motor driving shaft with an air-inlet bore penetrating its one end, while said anvil shaft with an air-outlet bore penetrating its other end.

12. A high-speed energy-accumulating pneumatic wrench as set forth in claim 10 wherein said flywheel is characterized by its two cavities:

i) first cavity, designed for accommodating said pilot valve, having a multi-cylindrical form, not only allowing said pilot valve to reciprocate between its retracted position and stretched position inside the cavity along the radial direction of said flywheel, but also forming a low-pressure chamber inside said flywheel; the low pressure chamber, serving as a part of the controlling air flow path, is a space confined by the walls of the first cavity and the end surface of said pilot valve inserted, therefore its volume is changed with the movement of said pilot valve; the shape of the end walls of the first cavity is designed to stop the said pilot valve at its retracted position and keep a minimum volume of said low-pressure chamber; and wherein a stopper is installed in the first cavity to restrict the outward movement and rotation of said pilot valve, and consequently one end-surface of said pilot valve is exposed to the low-pressure chamber, while the other one to the high-pressure chamber;

ii) second cavity, designed for accommodating said impact pin, having a cylindrical form and separated by the piston of said impact pin into an upper plenum and a lower plenum; wherein one end of the second cavity has an opening allowing said impact pin to stretch out, while the other end is plugged after said impact pin is installed.

13. A high-speed energy-accumulating pneumatic wrench as set forth in claim 10 wherein said flywheel is further characterized by its seven air passages:

i) an air inlet passage leading controlling air from the air-inlet bore of motor driving shaft to the annular plenum of said pilot valve;

ii) an air outlet passage, leading controlling air from the low-pressure chamber to said pressure impulse generator, having an inlet within the walls of the minimum volume of said low-pressure chamber so that its opening is never blocked by the movement of said pilot valve and an outlet against said pressure impulse generator to receive the pressure impulses;

iii) a charging/discharging passage connecting the high-pressure chamber with the annular plenum of said pilot valve when said pilot valve is retracted, or with a discharging passage in said pilot valve when said pilot valve is thrown out;

iv) a stretching passage, having an outlet at the top of the upper plenum of the second cavity, connecting the annular plenum of said pilot valve with the upper plenum of the second cavity when said pilot valve is thrown out, or connecting the upper plenum of the second cavity with an upper residual air release passage in said pilot valve when said pilot valve is retracted;

v) a retracting passage, having an outlet at the bottom of the lower plenum of the second cavity, connecting the annular plenum of said pilot valve with the lower plenum of the second cavity when said pilot valve is retracted, or connecting the lower plenum of the second cavity with a lower residual air release passage in said pilot valve when said pilot valve is thrown out;

vi) an upper feedback passage connecting the upper plenum of the second cavity with the high-pressure chamber via an upper feedback continuation passage in said pilot valve when both of said pilot valve and said impact pin are fully stretched; the upper feedback passage is closed by the piston of said impact pin during accumulation phase (A) and pre-impact phase (B) and closed by said pilot valve during pre-accumulation phase (D), having an inlet at the point of the upper plenum where the inlet is fully opened as the piston of said impact pin reaches its lower limitation;

vii) a lower feedback passage connecting the lower plenum of the second cavity with the low-pressure chamber when said impact pin is fully retracted; wherein the lower feedback passage is closed by the piston of said impact pin during impact phase (C) and pre-accumulation phase (D) and becomes idle during pre-impact phase (B), having an inlet at the point of the lower plenum where the inlet is fully opened as the piston of said impact pin reaches its upper limitation; and wherein all air passages in said flywheel are formed by one bore or by several (generally by two) connected bores drilled from the outer surface of said flywheel, and the ends of the bores which are unnecessary to connect with said high-pressure chamber are plugged at the outer surface of said flywheel.

14. A high-speed energy-accumulating pneumatic wrench as set forth in claim 10 wherein said pilot valve, capable of reciprocating between two positions in the first cavity of said flywheel, is characterized by an annular plenum and its four air passages:

i) an annular plenum connecting the air-inlet passage with the retracting passage and charging/discharging passage when said pilot valve is retracted, or with the stretching passage when said pilot valve is thrown out;

ii) an upper residual air release passage connecting the low-pressure chamber with the stretching passage when said pilot valve is retracted;

iii) a lower residual air release passage connecting the low-pressure chamber with the retracting passage when said pilot valve is thrown out;

iv) an upper feedback continuation passage connecting the high-pressure chamber with upper feedback passage when said pilot valve is thrown out;

v) a discharging passage connecting the low-pressure chamber with charging/discharging passage when said pilot valve is thrown out; and wherein all air passages in said pilot valve are formed by no more than two connected bores drilled inside said pilot valve.

15. A high-speed energy-accumulating pneumatic wrench as set forth in claim 10 wherein said impact pin, capable of stretching out from or retracting back into said flywheel, is integrated with a piston which separates the second cavity of said flywheel into an upper plenum and a lower plenum and, by means of its thickness, closes the lower feedback passage and opens the upper feedback passage when said impact pin reaches its fully stretched position, or closes the upper feedback passage and opens the lower feedback passage when said impact pin reaches its fully retracted position.

16. A high-speed energy-accumulating pneumatic wrench as set forth in claim 10 wherein said pressure impulse generator is a segmental block integrated with and situated on the end-surface of the anvil shaft against the outlet of the air outlet passage, and transmits pressure impulse periodically to the low-pressure chamber by changing flow resistance impulsively with each rotation of said flying hammer and thus triggers additional signal to said pilot valve.

17. A high-speed energy-accumulating pneumatic wrench as set forth in claim 10 wherein said driving shaft of air motor is directly engaged with said flywheel and aligned with its air inlet passage.

18. A high-speed energy-accumulating pneumatic wrench as set forth in claim 10 wherein said anvil shaft, with an anvil head inside said pressure container, capable of receiving impact from both direction.

* * * * *